US005564574A

United States Patent [19]

Kuryluk

[11] Patent Number: 5,564,574

[45] Date of Patent: Oct. 15, 1996

[54] MINERAL SEPARATOR

[75] Inventor: Michael H. Kuryluk, Elmsdale, Canada

[73] Assignee: Phase Remediation Incorporated, Nova Scotia, Canada

[21] Appl. No.: 470,994

[22] Filed: Jun. 6, 1995

[30] Foreign Application Priority Data

Feb. 17, 1995 [CA] Canada ..... 2,142,747

[51] Int. Cl.[6] ..... B07B 7/08

[52] U.S. Cl. ..... 209/731; 209/733

[58] Field of Search ..... 209/728, 731, 209/733, 734, 713, 714, 716, 720, 154

[56] References Cited

U.S. PATENT DOCUMENTS

| | | | |
|---|---|---|---|
| 1,483,371 | 2/1924 | Miller . | |
| 1,627,129 | 5/1927 | Unrath . | |
| 1,990,129 | 2/1935 | Menzies . | |
| 2,552,378 | 5/1951 | McNeill . | |
| 2,927,693 | 3/1960 | Freeman et al. | 209/731 |
| 3,172,844 | 3/1965 | Kurz | 209/713 X |
| 4,696,737 | 9/1987 | Bouchillon | 209/731 X |
| 4,789,464 | 12/1988 | Kuryluk . | |
| 4,919,796 | 4/1990 | Vikio | 209/733 X |
| 5,437,794 | 8/1995 | Anderson | 209/733 X |

FOREIGN PATENT DOCUMENTS

| | | | |
|---|---|---|---|
| 799394 | 8/1958 | United Kingdom | 209/731 |

*Primary Examiner*—D. Glenn Dayoan
*Attorney, Agent, or Firm*—Barnes & Thornburg

[57] ABSTRACT

A method and apparatus for separating from a mixture materials having different specific gravities which can operate in a continuous manner and can separate particles of materials of non-uniform grain size. Water or other fluid is passed upwardly through an apparatus having an upper funnel in which is disposed a rotatable agitator having vanes or paddles which pass close to riffles on the wall of the funnel. Material to be separated is fed into the funnel and the upward flow of fluid is adjusted so that material of low specific gravity is carried up the funnel to an overflow discharge. With the agitator rotating, fine particles of the material to be separated and having a specific gravity higher than a certain figure are captured in "dead-zones" created behind the riffles and move down through the fluid to a discharge tube. Larger particles of the material to be separated move down through the upward flow of fluid to the discharge tube. The supply of fluid is periodically momentarily interrupted to eject material collected in or just above the discharge tube.

17 Claims, 3 Drawing Sheets

Figure 1:
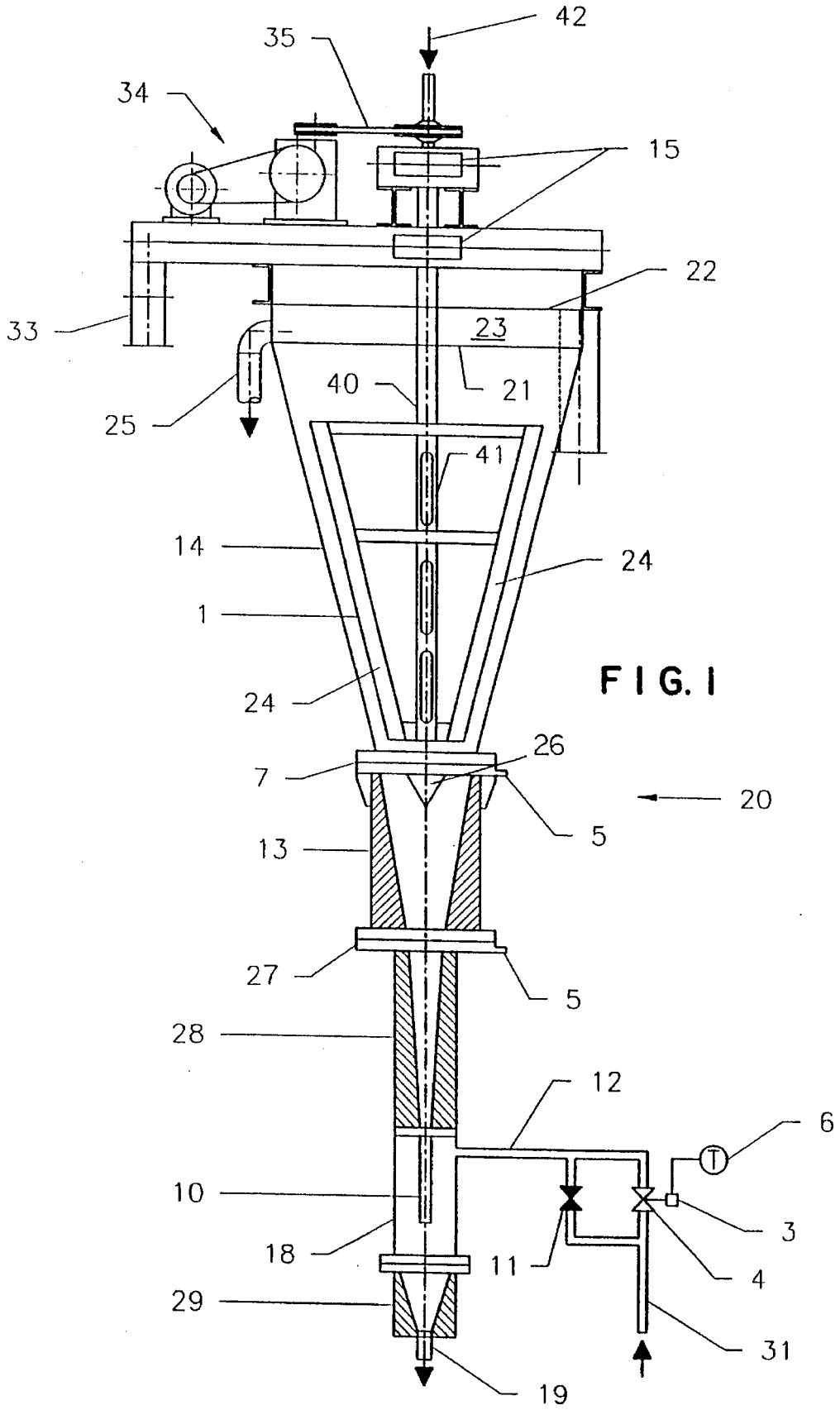

FIG. 4
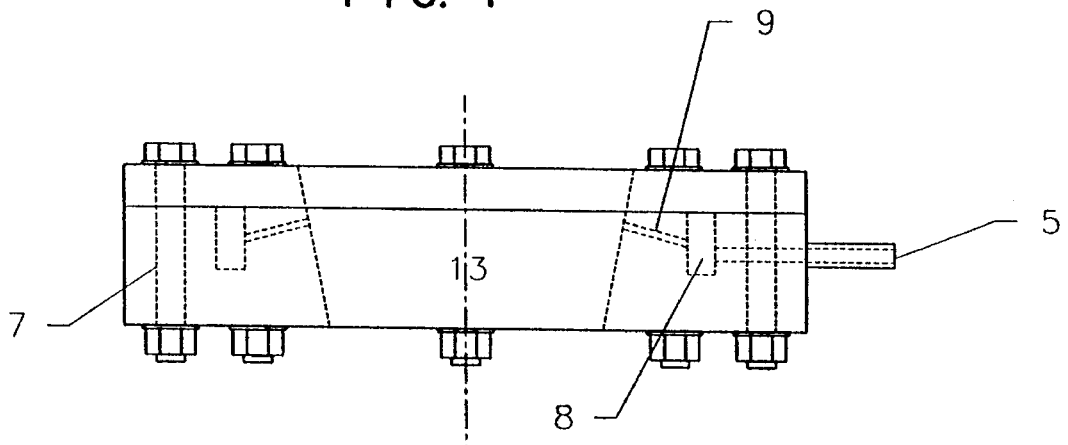
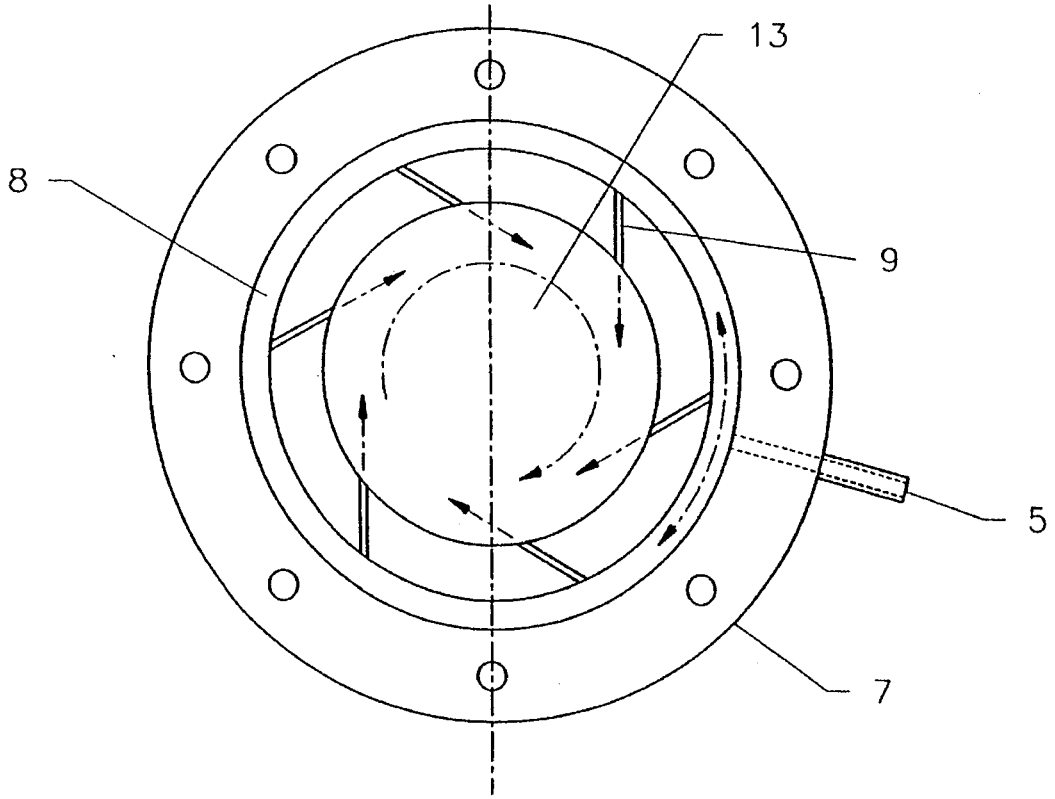
FIG. 3

MINERAL SEPARATOR

This invention relates to a method and apparatus for separating materials having different specific gravities from a mixture of the materials. The mixture may comprise various materials, e.g. two or more solid materials in particulate form, two or more liquids, or particles of solid material and a fluid. In the case of liquids, it is to be understood that they must not form intimate mixtures or emulsions but rather mix together somewhat poorly, e.g. oil and water.

Devices are known for separating metal particles from other particles of comminuted ore. See, for example, U.S. Pat. No. 1,483,371 issued to Joseph B. Miller on Feb. 12, 1924. The apparatus disclosed therein feeds water to the lower end of a stand-pipe, the upper end of which connects to an agitation-head. The agitation-head has an inlet for receiving comminuted ore and an outlet. Water rising in the stand-pipe swirls around in the agitation-head and gathers comminuted ore from the inlet. Lighter particles are carried by the water to the outlet while the heavier metal particles settle downwardly through the stand-pipe and into a container. The arrangement of the entire device inclusive of the container for collecting accepted particles is entirely enclosed and thus impossible to operate in a continuous manner.

An improved mineral separator is disclosed in may Canadian Patent No. 1,256,826 issued Jul. 4, 1989 and its U.S. counterpart, U.S. Pat No. 4,789,464 issued Dec. 6, 1988. The separator disclosed in those patents separates small solid particles having a generally uniform grain size and surface roughness but different specific gravities. Briefly, the separator disclosed in my aforementioned patents comprises an upright inner conduit means comprised of a transparent pipe open at both ends, and a funnel, the funnel being connected with the pipe at the upper end of the pipe and forming an upwardly and outwardly directed extension thereof. An upright transparent housing has a lower end surrounding the lower end of the pipe and is provided with a discharge opening disposed at a level below that of the lower end of the pipe. An upper portion of the housing is extended to contact the inner conduit means such that the housing upper portion encloses the inner conduit means at a point intermediate the upper end of the inner conduit means and the lower end of the pipe. A pipe securement means maintains the pipe within the housing. An overflow discharge is operatively associated with the funnel. The funnel is provided with a plurality of water jets arranged tangentially to maintain material in the funnel in a stirred or generally suspended state so that particles of a comminuted mixture can separate from each other within the funnel. A controlled flow of water is provided into the lower part of the housing such that particles of low specific gravity in the inner conduit means are carried to the overflow discharge while .particles of high specific gravity move down the pipe, exit from its lower open end into the lower part of the housing and then exit the discharge opening of the housing. By means of a scale marked on the pipe or the housing, the level of water in the housing can be adjusted to select particles having a specific gravity above a certain amount to be passed to the discharge opening of the housing.

The present invention provides a separator having a number of improvements as compared to that disclosed in my abovementioned patents. Increased efficiency of separation is achieved through:

a) addition of a rotating agitator paddle in the upper funnel, b) the provision of riffles in the upper funnel behind which low velocity "dead zones" are created, which collect the finer heavy material fraction, which then settles downwards, and c) introduction of dilution feed water (or other fluid) at one or more points in the lower funnel. These provide adjustable upward water velocity gradients in the lower chambers and allow fine tuning of the separation process, which is especially useful in continuous feed applications.

The apparatus of the present invention includes features better enabling continuous feed processes, such as:

a) the use of a variable interval pulse timer on the main water inflow to the lower chamber, which allows the device to drop out the heavy material fraction into the discharge area on a time pulsed basis, without having to manually draw off the collected heavy material. This is a key improvement in applying the device in continuous feed operation, (b) direct feed of material into a hopper.

The rotating agitator, the riffles and controllability of dilution water, combined with the pulsation system for the main water inflow, result in a high efficiency separator which can be used to separate materials having a broader range of grain sizes than that disclosed in my abovementioned patents.

According to a broad aspect of the invention there is provided apparatus for separating a first material having a particular specific gravity from a mixture with at least one other material having a lower specific gravity, said apparatus comprising a funnel having a lower small end and an upper large end, said funnel having a wall with an inner surface and an outer surface, a plurality of riffles on said inner surface extending from adjacent said lower end to adjacent said upper end, an agitator mounted for rotation within said funnel, said agitator comprising a plurality of vanes extending from adjacent said lower end upwardly to adjacent said upper end, each said vane having an outer edge adapted to move past said riffles in close proximity thereto upon rotation of said agitator, means for rotating said agitator, means for feeding said mixture into said funnel, a first means for supplying fluid to the lower end of said funnel, overflow means for removing fluid from the upper end of said funnel, and means to remove said first material from the lower end of said funnel.

According to another broad aspect of the invention there is provided a method for separating a first material having a particular specific gravity from a mixture with at least one other material having a lower specific gravity, comprising feeding said mixture into a funnel having a lower small end and an upper large end, said funnel having an inner surface and an outer surface and having a plurality of riffles on said inner surface extending from adjacent said lower end to adjacent said upper end, supplying fluid to the lower end of said funnel from a primary source and removing fluid from the upper end of said funnel, causing said fluid and the mixture contained therein to swirl around in said funnel whereby some of said first material is captured in "dead zones" created by said riffles and moves downwardly in said funnel, and removing said captured material from the lower end of the funnel.

Figure 2A:
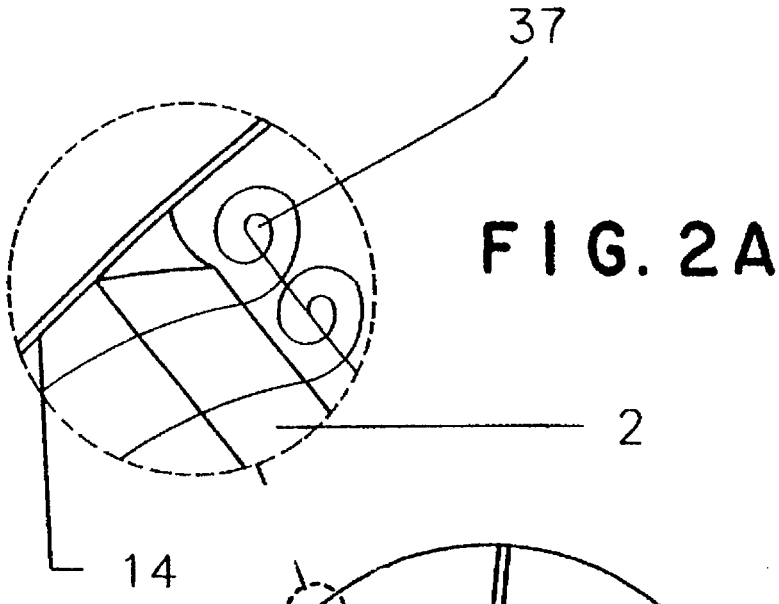
Figure 2:
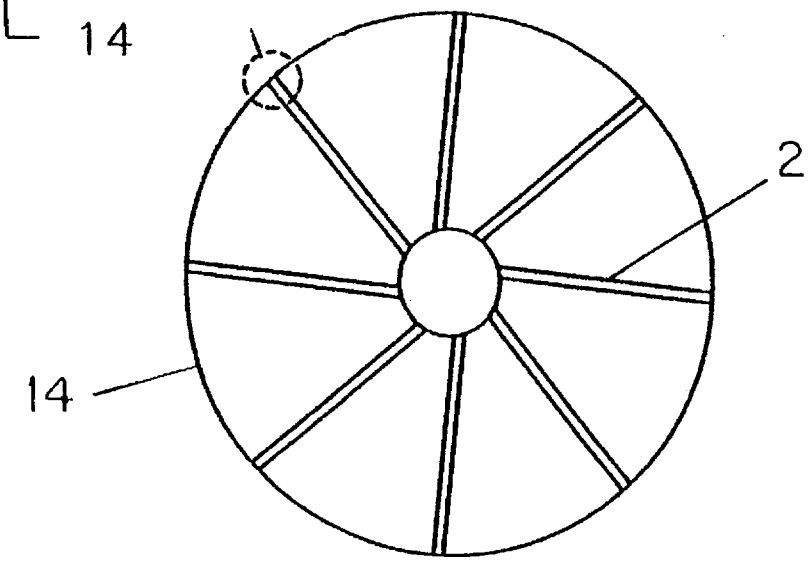

A presently preferred embodiment of a material separator according to the invention will now be described in conjunction with the accompanying drawings, in which:

FIG. 1 is an elevational view, partly in cross-section, of a separator according to the invention, FIG. 2 is a simplified plan view of the upper funnel to illustrate and explain the riffles provided in the upper funnel, FIG. 2*a* is an enlarged view of a detail of FIG. 2 showing the creation of dead zones, FIG. 3 is an elevational view of a water dilution chamber, and FIG. 4 is a plan view of a water dilution chamber.

The following description of the embodiment illustrated in the drawings will first be in connection with the separation of a mixture of solid particles which may be referred to below (or above) as "heavy" particles and "light" particles, or similar terms. It is to be understood that the terms "heavy" and "light" refer to particles or materials having, relative to one another, high or low specific gravities; they do not refer to the mass of the particles. A large "light" particle could have more mass than a smaller "heavy" particle.

Referring to FIG. 1, a separator apparatus according to the invention is generally indicated at 20. It includes an tapper funnel 14 having an upper end 21 which is closed by a cover member 22 defining a chamber 23. An overflow tube 25 connects to chamber 23. The lower end 26 of the upper funnel 14 is connected to a mixing chamber 13 which has a first or upper dilution chamber 7 connected to its upper end and a second or lower dilution chamber 27 connected to its lower end. The lower side of dilution chamber 27 is connected to a lower funnel portion 28 which, in turn, is connected to a high velocity tube or pipe 10, having its lower end disposed in a low velocity chamber 18. Chamber 18 is connected with a concentrate collector 29 having a discharge tube 19. The exit diameter of tube 19 must be smaller than the internal diameter of velocity tube 10 so that substantially more of the water supplied at 12 to chamber 18 will enter tube 10 rather than exit via discharge tube 19. Water is fed from a water supply (not shown) to a pipe 31 as indicated by an arrow at the end of the pipe 31. From there the water flows through a valve 4 which is regulated in a pulsed on-off manner by a timed on-off pulse switch or actuator 3, for a reason to be explained later. A by-pass valve 11, normally closed, may be opened, and valve 4 closed, if it is desired to provide a steady flow of water to chamber 18.

An agitator or mixer 1 is mounted for rotation on brackets 15 attached to the main support for the apparatus, partially shown at 33, so that the agitator is suspended within the upper funnel 14. The agitator can be rotated by a drive arrangement 34 via an endless belt or chain 35. Rotation speeds may De varied to suit the size and density of the materials being separated. A typical rotation speed is 40 rpm.

FIGS. 3 and 4 show the structure of a dilution chamber, in this case dilution chamber 7. The dilution chambers provide a means of local water velocity control. Water from a variable control feed source (not shown) is fed to dilution chamber 7 via an inlet tube 5 connected to an annular distributor ring 8 from which water is fed through multiple feeder passages 9 into the mixing chamber 13. The added water creates a centrifugal spinning motion and increases the vertical water velocity allowing additional control over particle settling rates by variation in the water feed rate. The diameter and number of feeder passages may vary, as may the vertical and horizontal angles of the passages 9. Any number of dilution chambers may be used, two being shown in FIG. 1. The dilution chambers maintain a fluidized bed of material in the lower section of the funnel 14.

Referring to FIG. 1, the inner surface of the upper funnel 14 is provided with a number of sluice riffles. Although not shown in FIG. 1, FIG. 2 illustrates a riffle 2. It is illustrated as roughly triangular in cross-section but could be of some other shape such as rectangular. Variations may be made in the number, length, width, height, position, material and cross-sectional shape and angle of attachment to the funnel 14. Preferably, the riffles run essentially straight up and down the inner wall of funnel 14. The riffles act as turbulators, similar to riffles in a conventional gold sluice, behind which zones of zero or very low velocity occur as indicated at 37 when the agitator 1 is rotating. These zones of zero or low velocity 37 allow settling out of fine (small size) heavy particles. Gravity acts on the particles in the stagnant "dead-zone" 37, causing them to move downwardly along the riffle 2 towards the base of the funnel 14.

As shown in FIG. 1, the agitator 1 includes a hollow shaft 40 provided with a plurality of openings 41. Material mixtures to be separated are fed into the top of the hollow shaft as indicated by arrow 42 and exit into funnel 14 via the openings 41. However, this is only one possible means for feeding material to funnel 14; it could, for example, be fed into the funnel through an opening in the wall of the funnel instead of through the shaft 40. The agitator 1 includes a plurality of vanes or paddles 24 running parallel to the inner wall of the upper funnel 14 and spaced therefrom so as to pass close to the riffles 2 when the agitator 1 is rotated. Rotation of the vanes 24 of the agitator 1 causes the contents of upper funnel 14 to swirl around past the riffles 2, creating the dead-zones 37.

In operation of the apparatus shown in the drawings, water is fed to the lower chamber 18 by main water feed 12 at a rate selected, based on experimentation, in accordance with the materials to be separated. Most of the water flows into high velocity pipe 10 and up to chamber 14 while some water (and separated material) flows out of discharge tube 19. Additional water is added, in mixing chamber 13, via dilution chamber 26 and in the lower end of upper funnel 14 via dilution chamber 7. The total water flow rate provided by the main water feed 12 and the dilution chambers 7 and 27 is adjusted so that material having a specific gravity higher than a predetermined figure can move downwardly against the upward flow of water while materials having a specific gravity lower than the predetermined figure cannot. The agitator 1 is caused to rotate and materials to be separated are fed in via the hollow shaft 40. Because of the rotation of agitator 1, which causes the water and the particles therein to swirl around in the upper funnel 14, fine particles of material of high specific gravity present in the water are subjected to centrifugal forces and tend to move out to the wall of the upper funnel 14 where they become caught in the "dead-zones" 37 behind the riffles 2. These fine particles of heavy material can then move downwardly along the wall of funnel 14 and then along the wall of mixing chamber until eventually they are ejected from discharge tube 19 together with the larger sized heavy particles which have sufficient mass to be able to move downwardly against the upward flow of water. Because of the centrifugal forces created by the rotating agitator, fine particles of heavy material are directed to the wall of the funnel out of the comparatively fast upward flow of water which would otherwise carry them out of the overflow 25. Water exits the apparatus via overflow tube 25, carrying material having a specific gravity less than the predetermined figure.

As mentioned above, the main water feed 12 is preferably regulated at a pulsed rate by valve 4 activated by timed on-off switch 3. The pulsing is necessary on a continuous feed operation to allow any accumulated concentrate in high velocity pipe 10 to flow into the low velocity chamber 18 and then on to the concentrate collector 29 while the main water flow is momentarily interrupted. When the main water flow resumes, the material in the concentrate collector 29 is forcefully ejected via discharge tube 19. The exit diameter of tube 19 must be of smaller diameter than the internal diameter of high velocity tube 10, as discussed above. By adjusting the water flow rate and on-off pulse rate, the optimum discharge rate of concentrate may be achieved. The apparatus is, however, capable of being operated manually.

The action of the dilution chambers 7 and 26 has been described above. However, by way of further explanation, if the dilution chambers were omitted, a dense concentration of collected material could form in the lower funnel portion of the apparatus, thus hindering upward movement of water and downward movement of the material being separated. The additional water injected by the dilution chambers enables the density to be kept at a relatively low level. The resulting dilution increases the spacing among the collected particles, which is particularly useful if the particles are small, e.g. small particles of gold.

It will be appreciated that the apparatus of this invention can separate mixtures comprising more than two materials. For example, the heaviest material can be separated first, then the next heaviest, and so on. This could be done by multiple passes through one device or the overflow from one device could be fed into a subsequent separation device and so on.

One particularly useful application of the present invention is for cleaning contaminated soil, for example separating mercury from mercury-contaminated soil, for which it is very effective. The invention can also be used to remove other contaminants from soil such as hydrocarbons or metal oxides. The separation action can in some cases be enhanced by adding appropriate adjuvants to the water. For example, the addition of surfactants improves the rate of removal of hydrocarbons from soil and the addition of an acid such as hydrochloric acid, sulphuric acid or nitric acid improves the rate of removal of metal oxides from soil.

After being treated in accordance with the invention, the now de-contaminated soil can be returned to where it was removed from or otherwise used. The fluid from overflow 25 can be subjected to other types of processing, if desired.

Another contemplated application of the invention is the removal of hydrocarbons from "tar sands" using hot water and/or surfactants.

In some cases one could use a gas instead of a liquid in the separator, air being the most convenient. In such cases, the particles would be very small, such as fly ash from a coal burning plant which could be treated to separate sulphide mineralization such as arsenopyrite or chalcopyrite from the much lighter carbon particles.

The apparatus according to this invention can also separate liquids from a mixture of liquids of different specific gravities, e.g. oil and water. It can separate solid particles from a gas, e.g. fine dust from air. Obviously, the materials of the mixture to be separated must be such that they retain their separate identity in the mixture and do not chemically combine or comprise one material dissolved in another, such as sugar in water.

I claim:

1. Apparatus for separating a first material having a particular specific gravity from a mixture with at least one other material having a lower specific gravity, said apparatus comprising a funnel having a lower small end and an upper large end, said funnel having a wall with an inner surface and an outer surface, a plurality of riffles on said inner surface extending from adjacent said lower end to adjacent said upper end, an agitator mounted for rotation within said funnel, said agitator comprising a plurality of vanes extending from adjacent said lower end upwardly to adjacent said upper end, each said vane having an outer edge adapted to move past said riffles in close proximity thereto upon rotation of said agitator, means for rotating said agitator, means for feeding said mixture into said funnel, a first means for supplying fluid to the lower end of said funnel, overflow means for removing fluid from the upper end of said funnel, and means to remove said first material from the lower end of said funnel.

2. Apparatus as claimed in claim 1 including a second means for supplying additional fluid to the lower end of said funnel.

3. Apparatus as claimed in claim 2 and further comprising a funnel-shaped mixing chamber, said mixing chamber having an upper end connected to said means for supplying additional fluid to the lower end of said funnel.

4. Apparatus as claimed in claim 3 wherein said means for supplying additional fluid to the lower end of said funnel comprises a dilution chamber.

5. Apparatus as claimed in claim 4 wherein said mixing chamber has a lower end connected to a further dilution chamber.

6. Apparatus as claimed in claim 5 wherein said further dilution chamber is connected to a lower funnel portion.

7. Apparatus as claimed in claim 6 wherein said lower funnel portion is connected to a high velocity pipe disposed in a low velocity chamber connected to a primary source of said fluid.

8. Apparatus as claimed in claim 7 wherein said means to remove said first material comprises a concentrate collector connected to said velocity chamber for collecting said first material and a discharge tube connected to said concentrate collector for discharging said first material.

9. Apparatus as claimed in claim 7 including means for periodically momentarily interrupting said first means for supplying fluid to the lower end of said funnel.

10. Apparatus as claimed in any one of claims 5–9 wherein each said dilution chamber comprises an inlet tube connected to an annular distribution ring and a plurality of feeder passages, said feeder passages supplying said additional fluid.

11. Apparatus as claimed in any one of claims 1–9 wherein said fluid is a liquid.

12. Apparatus as claimed in claim 11 wherein said liquid is water.

13. A method for separating a first material having a particular specific gravity from a mixture with at least one other material having a lower specific gravity, comprising feeding said mixture into a funnel having a lower small end and an upper large end, said funnel having an inner surface and an outer surface and having a plurality of riffles on said inner surface extending from adjacent said lower end to adjacent said upper end, supplying fluid to the lower end of said funnel from a primary source and removing fluid from the upper end of said funnel to create an upward flow of fluid, causing said fluid and the mixture contained therein to swirl around in said funnel whereby fine particles of said first material are captured in "dead-zones" created by said riffles and move downwardly in said funnel together with larger particles of said first material which move downwardly through said upward flow of fluid while said at least one other material is removed from the upper end of said funnel by the upward flow of said fluid, and removing said first material from the lower end of the funnel.

14. A method as claimed in claim 13 and further comprising periodically momentarily interrupting said supplying of fluid by said primary source.

15. A method as claimed in claim 13 further comprising supplying additional fluid from at least one secondary source disposed between said primary source and said funnel.

16. A method as claimed in any one of claims 13–15 wherein said fluid is a liquid.

17. A method as claimed in claim 16 wherein said liquid is water.

* * * * *